United States Patent [19]

Corona et al.

[11] Patent Number: 4,716,795

[45] **Date of Patent: * Jan. 5, 1988**

[54] MULTI-OBJECT HAND HELD IMPLEMENT

[76] Inventors: Antonio Corona; Franco O. Corona, both of 175 Cumberland Street, Ste. 1805, Toronto, Ontario, Canada, M5R 3M9

[ * ] Notice: The portion of the term of this patent subsequent to Nov. 12, 2002 has been disclaimed.

[21] Appl. No.: 845,930

[22] Filed: Mar. 28, 1986

Related U.S. Application Data

[63] Continuation-in-part of Ser. No. 796,635, Nov. 8, 1985, abandoned, which is a continuation of Ser. No. 700,830, Feb. 12, 1985, Pat. No. 4,552,044.

[51] Int. Cl.[4] ..... B25G 1/08

[52] U.S. Cl. ..... 81/177.4; 81/490

[58] Field of Search ..... 81/177.4, 437, 438, 81/439, 490; 7/167, 165, 170

[56] References Cited

U.S. PATENT DOCUMENTS

| | | | |
|---|---|---|---|
| 3,405,749 | 10/1968 | Butler | 81/177.4 |
| 4,241,773 | 12/1980 | Personnat | 81/177.4 |
| 4,372,361 | 2/1983 | Whiteford | 81/177.4 |
| 4,463,788 | 7/1984 | Corona et al. | 81/177.4 |
| 4,552,044 | 11/1985 | Corona et al. | 81/490 |

FOREIGN PATENT DOCUMENTS

| | | |
|---|---|---|
| 951860 | 11/1956 | Fed. Rep. of Germany . |
| 2408434 | 6/1977 | France . |

*Primary Examiner*—Frederick R. Schmidt
*Assistant Examiner*—Maurina Rachuba
*Attorney, Agent, or Firm*—Willian Brinks Olds Hofer Gilson & Lione Ltd.

[57] ABSTRACT

A multibit hand tool has a plurality of bits provided in a circular pattern within a handle magazine. A rotatable selector cup at the end of the handle permits selection of a desired bit from the magazine and placement in a chuck in the handle. An elongate slot is provided in the cup to permit the manipulation of the bit. An improved guidance arrangement is provided for guiding movement of a bit withdrawn from the handle magazine for insertion in the chuck. The guide device prevents rotation of the screwdriver bit while being transferred from the magazine to the chuck. An improved arrangement is provided for retaining a bit withdrawn from the handle magazine within the bit selector cup so that bits are not lost. The mounting of the bit selector cup on the handle is improved to facilitate assembly and use of the bit selector cup.

15 Claims, 11 Drawing Figures

20
22
24
26
28
34
10
38
42
40
44
12
92
30
72
16
68
14
48
4
46
64
54
60
52
66
62
56
58
50
68
34
76
30
80
78
74
46
48
84
52
56
82
98
96
136

FIG. 8.
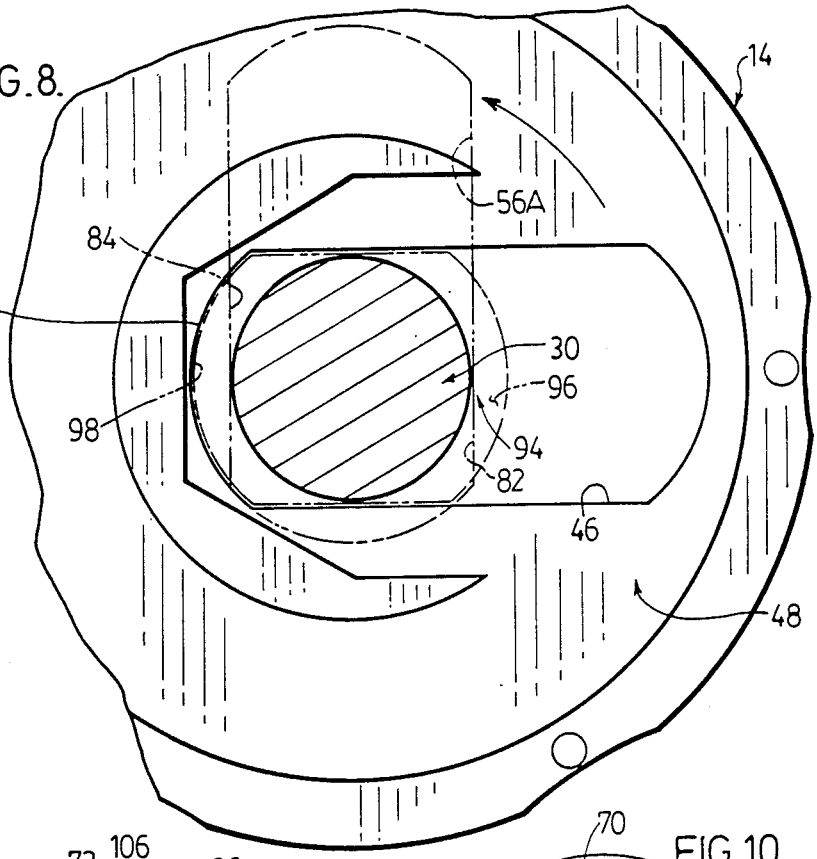
FIG. 9.
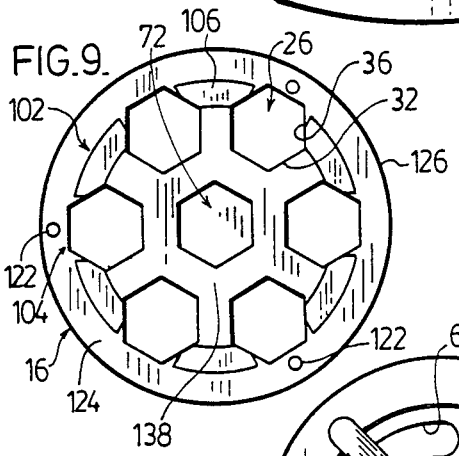
FIG. 10.
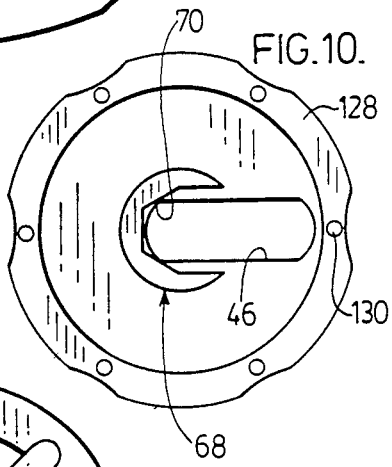
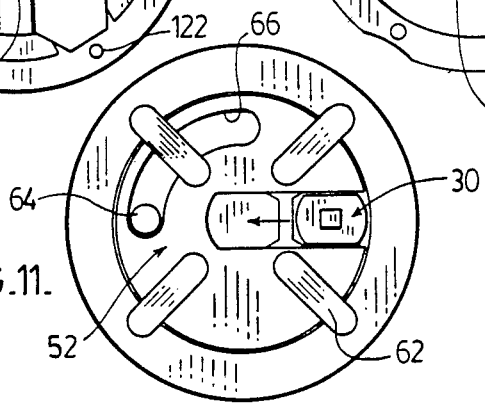
FIG. 11.

MULTI-OBJECT HAND HELD IMPLEMENT

This application is a continuation-in-part application of continuation application Ser. No. 06/796,635 filed Nov. 8, 1985, abandoned, which was a continuation of Ser. No. 700,830, filed Feb. 12, 1985 now U.S. Pat. No. 4,552,044, issued Nov. 11, 1985.

FIELD OF THE INVENTION

This invention relates to hand-held implements having interchangeable objects which are captured within the implement and selected object extendible from the implement for use.

BACKGROUND OF THE INVENTION

There are presently available on the marketplace many forms of multi-object devices. An example is in the multibit screwdriver where several bits are contained within the hollow handle. When it is desired to use a particular bit, the handle is opened by unscrewing the cap for the handle and selecting the needed bit. The selected bit is then placed in the chuck at the other end of the handle for use. This system results in the loss of bits, because the bits are not retained within the screwdriver handle.

Multibit screwdrivers are available which provide in one form or another arrangements which minimize or prevent loss of the screwdriver bits. Examples of these screwdrivers are found in U.S. Pat. Nos. 512,911; 2,765,013; 3,006,395; 3,194,286; 3,405,749; 4,241,773 and 4,463,788. A variety of techniques are disclosed in these patents for selecting a desired bit from a magazine in the handle and either extending it for immediate use or moving to a position for location in a chuck to drive the bit. U.S. Pat. No. 4,463,788 includes the use of a bit selector cup rotatably mounted on the bottom portion of the handle containing the bit. The bit selector cup includes a slot of a width and length to permit withdrawal of a selected bit from the handle magazine, transverse movement of the bit end to centrally of the handle for upward insertion into the chuck contained in the bottom portion of the handle. This type of screwdriver provides for a selection of multiple bits from the handle magazine yet locates the bit centrally of the handle for ease of use. This is contrasted with the screwdriver arrangements of U.S. Pat. Nos. 512,911 and 4,241,773, which involve securing of the bits offset from the centre of the handle axis. This eccentric securing of the bits relative to the central axis of the handle provides an eccentric motion when using the screwdriver. Thus the tool can only be used for the simplest of jobs. In U.S. Pat. No. 4,241,773, the selected bit is retained in the handle by providing an enlarged bit head which will not pass through the apertures of the selector disc. In this arrangement, the enlarged head acts as a device to retain the bit in the handle. However, this arrangement does not contemplate a bit selector cup which has an elongate slot therein to provide for transfer of a selected bit from the handle magazine to the centrally located chuck of the handle. To secure the selected bit in the handle, where each channel in the handle acts simultaneously as a magazine for the bit and also as the chuck, the selector disc is spring loaded to engage a groove in the shaft of the bit to lock the bit in place. This arrangement provides for locking of a selected bit in the handle each time a bit is withdrawn. This can result in difficulties in removing and selecting another bit in operations that require several quick changes from one bit to another.

SUMMARY OF THE INVENTION

The implement of this invention generally comprises a handle with a central longitudinal axis, an object selector cup rotatably mounted at an end of the handle to rotate about the central axis and a plurality of elongate objects provided peripherally of the handle in a generally cylindrical pattern about the handle axis. Each object is provided in the handle to extend essentially parallel to the handle's axis. A chuck is provided at the end of the handle where the chuck is aligned with the handle axis for receiving an object end and securing it against rotation. The cup has a continuous side wall with an interior surface spaced radially outwardly of the radial location of the circular pattern of objects and a closed cup end. An elongate slot extends from a central portion of the cup end and radially outwardly to the location of an object in the handle. The cup is rotatable to position the slot in register with any desired object in the handle. The slot in the cup has walls sufficiently spaced apart to permit outward withdrawal through the slot of an object shaft from the handle in a direction generally parallel with the handle axis. Means is provided for retaining the selected object in the cup. The object end is movable along the slot towards the cup centre into alignment with the chuck for insertion of the object end in the chuck.

According to an aspect of the invention, the implement is provided with the object shaft having a slot wall engagement means for engaging at least one of the slot walls to prevent thereby any significant rotation of the object relative to the slot as the withdrawn object is moved along the cup slot to the cup centre into alignment with the chuck. The handle has a plurality of channels for receiving a corresponding plurality of objects. Each of the channels has means for cooperating with the respective object to align the object slot wall engagement means with corresponding said slot wall when the cup slot is registered with the respective object to permit withdrawal thereof. The object slot wall engagement means is positioned on the object shaft to engage the at least one slot wall on withdrawal of the object from the channel prior to the alignment means in the channel disengaging from the withdrawn object. The alignment means predetermines the orientation of the object end relative to the chuck, whereby the slot engagement means maintains the predetermined object end orientation for direct insertion of the object end in the chuck.

According to another aspect of the invention, the aforementioned multibit screwdriver is provided with the object end having integrally formed therewith means for defining a shoulder which contacts the opposing cup slot wall portions. The shoulder means contacts the opposing slot wall portions for any rotational angular relationship of the object end with the slot. The shoulder means thereby constitutes the retaining means for retaining the object end within the cup so that the object end can be moved along the slot towards the cup centre for insertion in the chuck without loss of the object from the rotatable cup portion.

According to a further aspect of the invention, the aforementioned implement is provided with the object end having outwardly projecting portions for cooperation with the chuck. The handle has a plurality of channels for receiving the objects. Each channel has recessed portions extending along its length to receive the object end outwardly projecting portions. A circular flange depends from the handle end and has a plurality of slots extending therethrough. Each of the slots is radially aligned with a respective said recess portion in one of the channels. The slot in the flange receives one of the outwardly projecting portions of the object end upon withdrawal of a object from a corresponding channel for insertion into the chuck.

According to yet another aspect of the invention, the implement may have two or more of the above identified aspects of the invention in combination.

BRIEF DESCRIPTION OF THE DRAWINGS

Preferred embodiments of the invention are shown in the drawings, wherein:

FIG. 8 is a top plan view from within the bit selector cup demonstrating locking of the bit shaft in the cup end;

FIG. 9 is a bottom view of the handle of FIG. 3;

FIG. 10 is a top plan view of the bit selector cup; and

FIG. 11 is a bottom plan view of the assembled hand tool.

DETAILED DESCRIPTION OF THE PREFERRED EMBODIMENTS

Figures 1, 2:
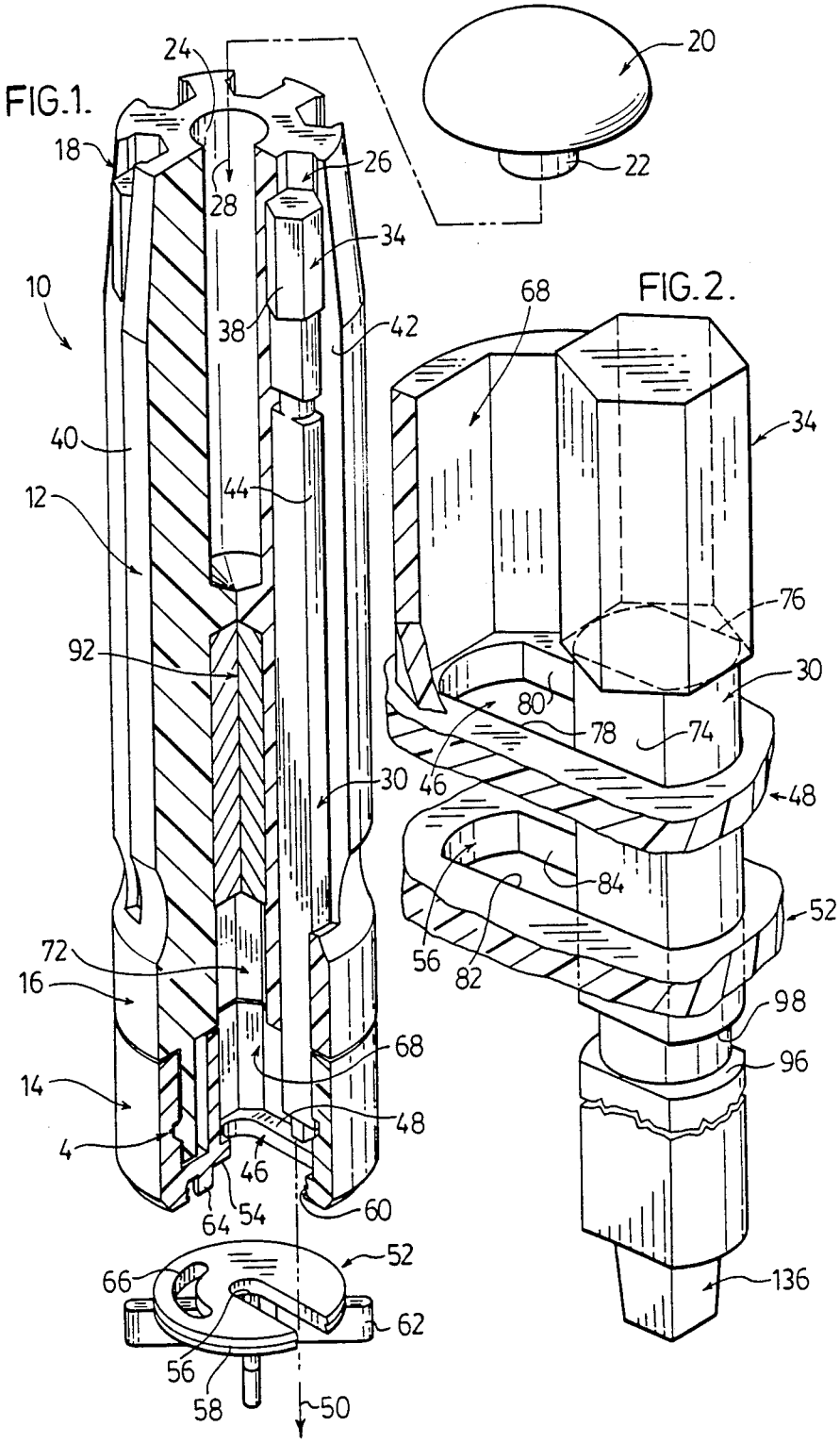
FIG. 1 is a perspective view of the handtool according to an embodiment of this invention having a section removed to illustrate internal portions thereof.
FIG. 2 is an exploded view of the bit end portions of the rotatable selector cup to demonstrate the manner in which the bit is retained within the hand tool selector cup.

It is appreciated that the invention may be incorporated or used in a variety of hand held implements. For purposes of explaining the invention, reference will be made to an embodiment in the form of a multibit screwdriver 10 which is shown in FIG. 1. The screwdriver 10 consists of a handle portion 12 with a rotatable bit selector cup 14 mounted at the bottom end 16 of the handle. Enclosing the top end 18 of the handle is a cap 20 having a stub portion 22 which is secured in the circular cavity 24. It is appreciated that the lid 20 may be permanently secured to seal off the cap 24, or a releasable catch may be used between the stub 22 and the cavity wall to permit removal of the cap 20 to provide for storage of various items in cavity 24.

The handle 12 has a plurality of channels 26 provided therein, all of which extend in the direction parallel to the longitudinal axis 28 of the handle. The channels 26 are arranged generally in a circular pattern about the central axis 28 of the handle. The channels provide a bit magazine within the handle for the plurality of bits to be carried by the handle. According to this particular embodiment, six channels are provided about the perimeter of the handle to thereby provide six different shapes of bits or tools 30 for selective use with the screwdriver. It is appreciated that the hand tool may be used as an implement to carry a variety of different types of elongate objects which would be selectively presented. For example, instead of the elongate objects being tool bits, the elongate objects may be a variety of ink ball point pens, different coloured pencils, different coloured cosmetic make-up pencils or lipsticks, various small utensils such as kitchen items and the like. It is also appreciated that tool bits may, in addition to screwdriver bits, include files, knives, awls, chisels, etc. It is appreciated that each object would be elongate and resemble in shape the important aspects of the bits shown in the drawings which provide the advantages and features of the invention may be accomplished.

As shown in FIG. 9, the lower portion 32 of each channel 26 is hexagon-shaped to receive the corresponding hexagon shape for the enlarged bit head 34. Thus, the channel has a plurality of recesses in the form of internal faces 36, as shown in FIG. 9, to receive the corresponding outwardly projecting external faces 38, as shown in FIG. 1, on the enlarged bit head. The upper body of the handle 12 includes opening up one of the recessed faces 36 to the peripheral portion 40 of the handle to provide thereby openings 42 which expose the shaft portion 44 of the bit.

The rotatable selector cup 14 has an elongate slot 46 provided in the cup lower wall 48. The slot is aligned with the selected bit shaft 44 to permit withdrawal of the bit 30 from the channels 26 in the direction of arrow 50. According to this preferred embodiment of the invention, a disc 52 is rotatably mounted to the underside 54 of the cup end 48. The disc 52 has a slot 56 formed therein corresponding to the shape and size of the slot 46 in the cup end. The disc 52 is provided about its periphery with ridges 58 which are snapped into the corresponding recesses 60 of the cup bottom. The disc 52 is rotated relative to the cup end by manipulating fingure lugs 62. A pin 64 is provided in the cup end which extends through arcuate slot 66. This provides a stop which permits 90° rotation of the disc 52 from a position of aligning slot 56 with slot 46 in the rotatable cup to a position where the slot 56 extends transversely of the slot 46. The purpose of this disc arrangement is discussed in more detail with respect to FIG. 8.

Within the bit selector cup 14, an upstanding U-shaped guide 68 has interior faces 70, as shown in more detail in FIG. 10, which correspond in shape to a section of the enlarged head 34 of the bit. This allows radial movement of the bit head 34 to within the U-shaped guide 68. The chuck 72, as shown in FIG. 1, is aligned with the faces 70 of the U-shaped guide to permit direct insertion of the enlarged bit head into the chuck 72. The enlarged bit head 34 includes a number of external operative faces equal to or a multiple of the number of bits in the handle magazine. Correspondingly, the chuck 72 has a number of internal operative faces equal to or a multiple of the number of operative faces on the enlarged bit head 34. This provides for a predetermined orientation of the bit head 34 relative to the chuck 72, such that the bit head may be directly inserted into the chuck 72 providing the predetermined orientation of the bit head is maintained as the withdrawn bit is moved along the slot 46 into alignment with the chuck 72.

As shown in FIG. 2, the bit shaft 30, which is normally circular, is provided with an arrangement which cooperates with the cup end slot 46 to maintain alignment of the predetermined orientation of the enlarged bit head 34 relative to the chuck interior faces 72. According to this preferred embodiment, the bit shaft 30 has provided thereon two diametrically opposite flats 74 and 76, as shown in dot on the rear side. The distance between flats 74 and 76 is slightly less than the distance between the opposing wall portions 78 and 80 of the slot 46. The recesses 36 in the walls of the channel 26 are oriented in a manner so as to align and register the flats 74 and 76 with the slot walls 78 and 80. When the rotatable bit selector cup 14 is rotated to align its slot 46 with a desired bit 30, the bit may be withdrawn from the channel 26 in the direction of arrow 50, as shown in FIG. 1. The flats 74 and 76 pass by the opposing slot walls 78 and 80 and in the embodiment where the disc 52 is used, passes by the opposing slot walls 82 and 84 of slot 56. With this cooperation and engagement between the flats of the bit shaft and the slot walls, the bit shaft may be moved along the slot 46 and prevent any significant rotation of the bit relative to the slot. The flats 74 and 76, according to this embodiment, extend along the length of the bit shaft 30. Thus the flats are aligned with the slot by the recesses in the channel 26 where the flats engage the slot walls 78 and 80 prior to disengagement of the alignment recess 26 in the channel from the bit end. The channel, therefore in predetermining the orientation of the bit end relative to the chuck in combination with the bit guidance device, ensures that the enlarged head portion 34 of the bit is in register with the internal operative faces of the chuck 72 to permit direct upward insertion of the bit head into the chuck.

Figure 5:
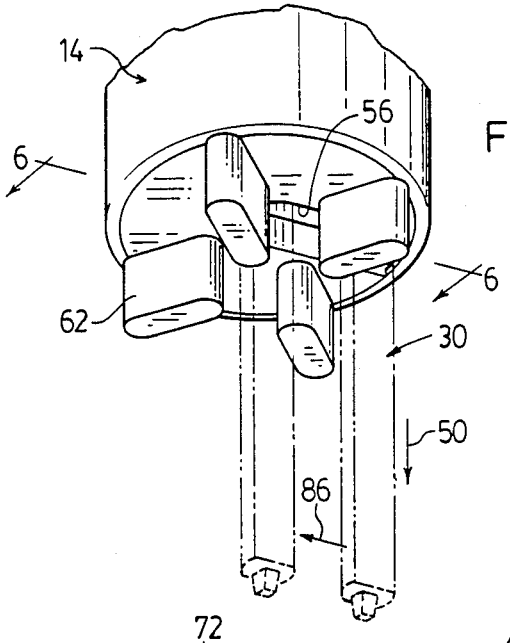
FIG. 5 is a perspective view of the bottom area of the hand tool of FIG. 1.
Figure 6:
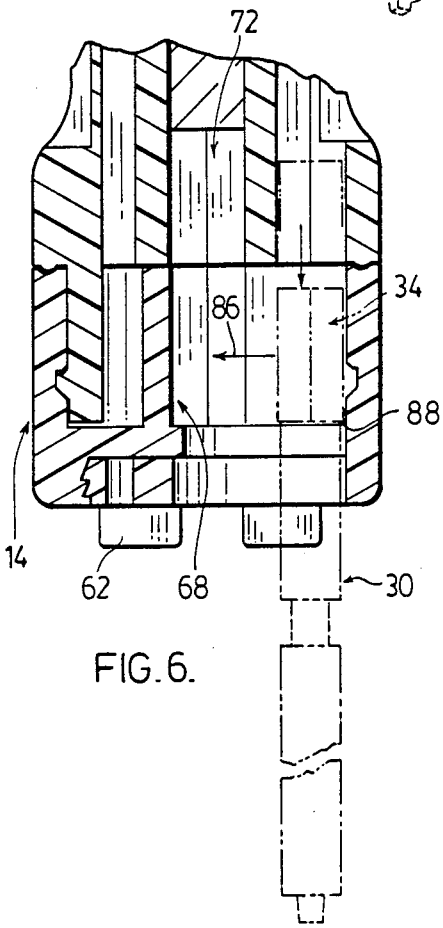
FIG. 6 is a section along the lines 6—6 of FIG. 5 illustrating withdrawal of a selected bit from the handle magazine.
Figure 7:
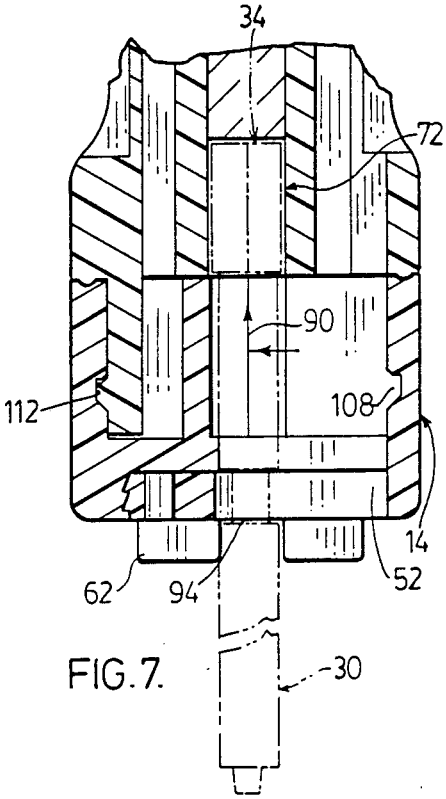
FIG. 7 is the section of FIG. 6 illustrating insertion of the retained bit end in the handle chuck.

Turning to FIGS. 5, 6 and 7, the bit shaft 30 is withdrawn from the magazine through the disc slot 56 in the direction of arrow 50. The flat surfaces of the bit shaft engage the slot walls to ensure alignment as the bit is transferred in the direction of arrow 86. As shown in FIG. 6, the enlarged head portion 34 of the bit provides a shoulder 88 which is of a dimension larger than the width between the slot walls 78 and 80. Thus the shoulder on the bit 31 adjacent the head portion 34 provides a device for retaining the bit in the bit selector cup 14. As the shoulder 88 engages the upper surfaces of the slot walls 78 and 80, the bit may be slid radially along the slot in the direction of arrow 86. The upstanding bit guide 68 has its faces arranged to receive the corresponding shape of the bit head and, as already explained, the chuck internal faces 72 are aligned with the bit guide 68 to provide for direct upward insertion of the bit end 34 into the chuck 72 in the direction of arrow 90 of FIG. 7.

Above the chuck 72, as shown in FIG. 1, is a magnet 92 for use with bits which have magnetizable head portions 34. The magnet 92 attracts and assists insertion of the bit head portion into the chuck. For most uses, the attraction of the bit of the magnet retains the bit in the chuck. However, in some instances, it is necessary to securely lock the bit in the chuck, such as for example when the chosen bit includes a pointed end which may be used as an awl or the like. To lock the bit in the chuck, according to this preferred embodiment, the bit shaft 30, as shown in FIG. 2, includes a groove 94 in the shaft of a height equal to at least the thickness of the disc 52. The groove 94 is spaced below the bit end a distance which locates the groove at the disc 52 when the bit end is completely inserted in the chuck 72. With the enlarged head portion 34 located in the chuck 72, as shown in FIG. 7, the thickness of the disc 52 corresponds with the height of the groove 94, thereby permitting rotation of the disc 52. On rotating the disc, the slot wall of slot 56 of the disc is moved within the groove 94, whereby the upper and lower surfaces of the slot walls 82 and 84 abut the edges 96 and 98 of the groove in the bit shaft.

This action is shown in more detail in FIG. 8. The groove 94 defines the lower edge 96 of the bit shaft 30. The outer perimeter 98 of the bit shaft abuts the centrally located slot end portion 100. The slot 56 of the disc 52 was originally aligned with the slot 46 of the end wall 48 of the bit selector cup 14. Upon rotating the disc 52 ninety degrees as is accommodated by the pin 64 within the arcuate groove 66 as shown in FIG. 11, the slot can take on the new position as shown in FIG. 8 at **56*a*. The slot edge portions 82 and 84 lie within the groove 94 and abut the upper and lower edges 96 and 98 of the shaft to lock securely the bit end 34** in the chuck. In this manner, a selectively usable lock may be provided for the bit shaft to retain the bit in the chuck when desired. Otherwise, the magnet or just frictional engagement of the chuck with the bit end is sufficient for normal usage of the screwdriver.

Figure 3:
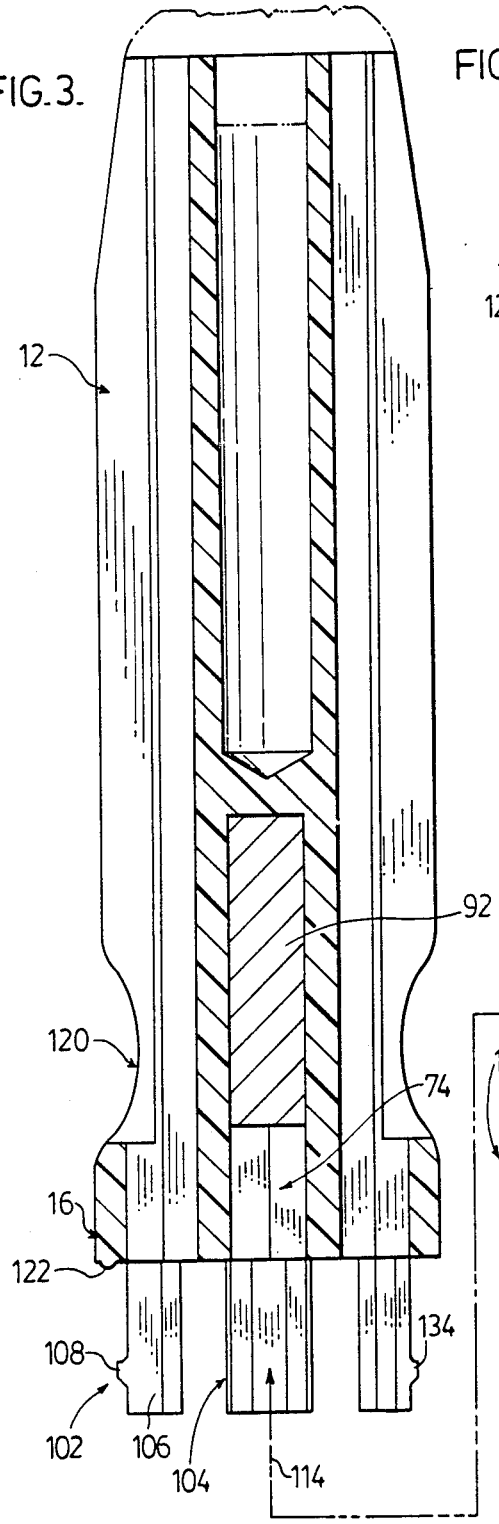
FIG. 3 is a section through the central axis of the hand tool of FIG. 1.

To provide for compactness in the structure of the screwdriver handle and rotatable cup, the handle portion has depending therefrom a circular flange generally designated 102 in FIGS. 3 and 9. The circular flange 102 includes a plurality of slots 104 which extend through the flange 102 to divide it up into a number of individual segments 106. Each slot 104 is aligned with a recess portion 36 of the respective channel to permit the projecting portion on the enlarged head 34 of the bit to pass outwardly of the channel and downwardly through the slot 104 as depicted in FIG. 6. By provision of the slots in the depending circular flange 102, the overall diameter of the handle may be reduced while at the same time providing segments 106 which include a device for mounting the rotatable cup 14 to the lower portion 16 of the handle.

Figure 4:
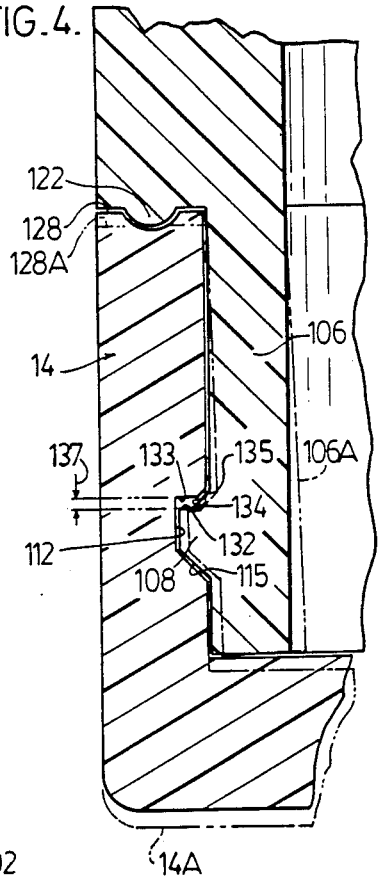
FIG. 4 is an enlarged view of designated area "4" of FIG. 1.
Figure 4:
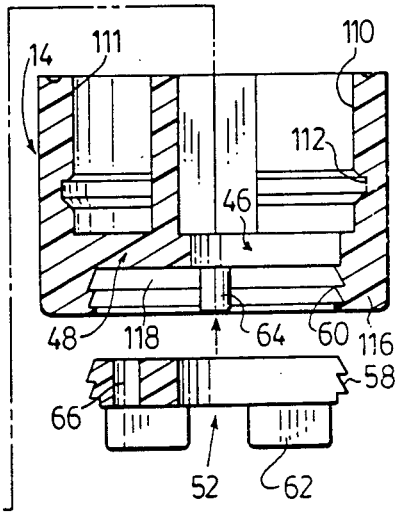

The individual segments 106 include outwardly projecting ridges 108 which are circumferentially aligned about the perimeter of the individual flange segments 106. As shown in FIG. 3, the interior surface 110 of the bit selector cup 14 includes a circumferential groove 112 of a shape to receive the corresponding shape of the ridge 108. The bit selector cup 14 may be placed onto the handle lower end 16 by simply pushing the selector cup in the direction of arrow 114. Due to the segmented flange portion, the individual segments 106 flex inwardly to allow the ridges 108 to snap into the groove 112 of the bit selector cup. Camming surface 115, as shown in FIG. 4, assists in the upper ridge 111 flexing the segments 106 inwardly during assembly of the selector cup to the handle. This arrangement provides a simple yet effective means of mounting the bit selector cup to the handle lower end 16. To the end 48 of the bit selector cup, the disc 52 is mounted. The end of the bit selector cup includes a depending circular ridge 116 defining a shallow cavity 118 with a circular wall having the ridges 60 formed therein to cooperate with the ridges 58 formed on the disc to hold the disc on the end of the bit selector cup, yet provide for rotation as manipulated by the finger lugs 62. Thus the bit selector cup and disc can be snap fitted together and, in turn, the assembled unit snap fitted onto the screwdriver handle 12. To facilitate use of the screwdriver handle 12, a recess portion 120 is defined about the periphery of the handle to facilitate positioning of the thumb in use of the apparatus.

A detent system is provided to index the bit selector cup 14 as it is rotated to visually and/or audibly indicate alignment of the bit selector cup slot 46 with the desired bit in the handle magazine. According to a preferred embodiment, the detent system comprises three depending dimples 122 extending downwardly from the underside 124 of the handle bottom 16 as shown in FIG. 9. The circular flange 102 is inwardly of the periphery 126 of the handle lower portion to thereby define the outer underside ring of the handle. The bit selector cup, as shown in FIG. 10, includes on its top wall 128 a plurality of recesses 130. The recesses 130 are located about the top wall 128 so that whenever a dimple 122 projects into a recess 130, the slot 46 is aligned with a bit about the handle magazine. To facilitate passage of the bit selector cup top wall 128 over the depending dimples 122, reference is made to FIG. 4. The ridge 108 has a shoulder portion 132. Inwardly thereof is an upwardly sloping surface 134. The groove 112 of the selector cup includes an internal shoulder portion 122 and an upwardly sloping surface 135 which is normally in mating engagement with surface 134. With these surfaces normally in contact, a space 137 is developed between shoulders 132 and 133 of the flange and the selector cup. When the selector cup is rotated, the dimples 122 will push the cup downwardly as they engage the cup top wall 128 to move it to the position 128*a*. This movement is accommodated by the surface 135 camming the flexible flange segments 108 inwardly as the shoulders 132 and 133 approach one another. Preferably the spacing between shoulders 132 and 133 is slightly greater than the height of dimples 128.

As soon as dimples 122 align with corresponding the three of six recesses 130 of the bit selector cup top wall, the cup snaps back to its normal position as shown in solid line in FIG. 4. In this manner, the bit selector cup may be rotated relative to the handle so as to position the slot at the desired bit. The bit selector cup may be provided with an arrow and a symbol may be provided at each bit location on the lower handle 16 to designate the type of bit in the particular channel. By aligning the arrow on the bit selector cup with the desired bit symbol, the slot is then in position to permit withdrawal of the desired bit. It is appreciated that bit detent devices may be provided in the upper portion of the screwdriver handle in the manner discussed in the aforementioned copending application Ser. No. 681,886. The detents hold the bits inwardly of the cup slot to permit rotation. Thus, the type of mounting for the bit selector cup to the handle can provide both the visual and audible indication that the slot is aligned with a particular bit in the handle magazine.

When all bits are retracted in the magazine, the depending finger lugs 62 on disc 52 are arranged so that the screwdriver may be stood on a countertop or other type of work bench. The disc is also useful to close off the slot in the bit selector cup when the screwdriver is not in use. This prevents a bit, which may be aligned with the selector cup slot, from falling out It is appreciated that a variety of bits may be housed in the handle magazine as shown in FIG. 2. The particular bit has a Robertson square headed bit 136. Other bits may include various sizes of other Robertson, Phillips and flat headed bit ends. Speciality bits may also be included which have sharp points, cutting knives and the like, as previously discussed.

The screwdriver handle, bit selector cup and optionally the disc portion may all be injected from a suitable plastic material which can withstand the impact and usage to which the screwdriver is put. The chuck 72 may include a metal insert to provide reinforcement and prevent wear. The bits themselves are normally formed of steel having case hardened working bit tips. As shown in FIG. 9, the section of the bottom of the handle has ribbing 138 about the respective channels 26 which is in the shape of a honeycomb to significantly increase the strength of the handle portion. Due to the chuck being aligned with the central axis of the screwdriver body, the handle will withstand hammer blows which are sometimes required in loosening screws from metal equipment.

Having described in detail preferred embodiments of the invention, it is appreciated that the screwdriver bits may include a variety of configurations for the enlarged bit head. The enlarged bit head, in providing a shoulder portion, eliminates the need of retaining rings and the like of the prior screwdriver arrangements. It is understood that the retaining arrangement may be used on screwdrivers having circular shaft portions which, although they may rotate while moving along the slot of the bit selector cup, they will not drop through the bit selector cup because of the shoulder being defined about the entire periphery of the screwdriver shaft. However, with the use of multi-faceted bit ends, a guide means is provided which involves interaction between the bit shaft and the cup slot walls to ensure the predetermined orientation of the bit head is maintained so that once the bit head is aligned with the chuck, it may be directly inserted thereinto. Furthermore in accordance with this arrangement, the bit selector cup can be readily injection molded because the bit guide, if used, can be planar and upstanding from the bottom end of the bit selector cup. There is no need to provide bit locking devices above the guide 68.

Although preferred embodiments of the invention have been described herein in detail, it will be understood by those skilled in the art that variations may be made thereto in using the invention in a variety of hand held implements such as other types of hand tool bits, or in carrying and presenting ink pens, pencils, cosmetic devices and the like.

We claim:

1. A hand held multi-object implement having a handle with a central longitudinal axis, an object selector cup rotatably mounted at an end of said handle to rotate about said central axis, a plurality of elongate objects provided peripherally of said handle in a generally circular pattern about said handle axis, each object being provided in said handle to extend essentially parallel to said handle's axis, a chuck provided at said end of said handle, said chuck being aligned with said handle axis for receiving an object end and securing it against rotation, said cup having a continuous side wall with an interior surface spaced radially outwardly of the radial location of said circular pattern of objects and a closed cup end, an elongate slot extending from a central portion of said cup end and radially outwardly to the location of said object in said handle, said cup being rotatable to position said slot in register with any desired object in said handle, said slot in said cup having opposing walls sufficiently spaced apart to permit outward withdrawal through said slot of an object shaft from said handle in a direction generally parallel with said handle axis, means for retaining a selected object end in said cup, said object end being movable along said slot towards said cup center into alignment with said chuck for insertion of said object end into said chuck, characterized in that said object shaft has a slot wall engagement means for engaging at least one of said slot walls to prevent thereby any significant rotation of said object relative to said slot as said withdrawn object is moved along said cup slot to said cup centre into alignment with said chuck, said handle having a plurality of channels for receiving a corresponding plurality of said objects, each of said channels having means for cooperating with a respective said object to align said object slot wall engagement means with corresponding said at least one slot wall when said cup slot is registered with said respective object to permit withdrawal thereof, said object slot wall engagement means being positioned on said object shaft to engage said at least one slot wall on withdrawal of said object from said channel prior to said alignment means in said channel disengaging said withdrawn object, said alignment means predetermining the orientation of said object end relative to said chuck whereby said slot engagement means maintains said predetermined object end orientation for direct insertion of said object end in said chuck, said object end having integrally formed therewith means for defining a shoulder which contacts said opposing slot walls, said shoulder means being said means for retaining said object end within said cup, said external operative faces of said object end projecting outwardly relative to said object shaft, said channel alignment means comprising recessed portions to receive said object end outwardly projecting portions, a circular flange depending from said handle end and having a plurality of slots extending therethrough, each of said slots being radially aligned with a respective said recessed portion of said channel, said slot in said flange receiving one of said outwardly projecting portions upon withdrawal of said object from a corresponding said channel.

2. A multi-object implement according to claim 1, characterized in that said object is selected from the group of objects consisting of a tool bit, a pen, a cosmetic make-up stick, and kitchen utensil.

3. A multi-object implement according to claim 1, characterized in that said object is a tool bit and said implement is a hand tool.

4. A multibit hand tool according to claim 3, characterized in that said slot wall engagement means is provided along substantially the length of said bit shaft.

5. A multibit hand tool according to claim 3, characterized in that said slot wall engagement means comprises an elongate flat surface extending along said bit shaft, said slot being of an essentially consistent width, said flat surface on engaging a corresponding said slot wall preventing rotation of said bit shaft as it is moved along said slot.

6. A hand held multi-object implement having a handle with a central longitudinal axis, an object selector cup rotatably mounted at an end of said handle to rotate about said central axis, a plurality of objects provided peripherally of said handle in a generally circular pattern about said handle axis, each object being provided in said handle to extend essentially parallel to said handle's axis, a chuck provided at said end of said handle, said chuck being aligned with said handle axis for receiving an object end and securing it against rotation, said cup having a continuous side wall with an interior surface spaced radially outwardly of the radial location of said circular pattern of objects and a closed cup end, an elongate slot extending from a central portion of said cup end and radially outwardly to the location of said objects in said handle, said cup being rotatable to position said slot in register with any desired object in said handle, said slot in said cup having opposing walls sufficiently spaced apart to permit outward withdrawal through said slot of a object shaft from said handle in a direction generally parallel with said handle axis, means for retaining a selected object end in said cup, said object end being movable along said slot towards said cup center into alignment with said chuck for insertion of said object end into said chuck, characterized in that said object shaft has a slot wall engagement means for engaging at least one of said slot walls to prevent thereby any significant rotation of said object relative to said slot as said withdrawn object is moved along said cup slot to said cup centre into alignment with said chuck, said handle having a plurality of channels for receiving a corresponding plurality of said objects, each of said channels having means for cooperating with a respective said object to align said object slot wall engagement means with corresponding said at least one slot wall when said cup slot is registered with said respective object to permit withdrawal thereof, said object slot wall engagement means being positioned on said object shaft to engage said at least one slot wall on withdrawal of said object from said channel prior to said alignment means in said channel disengaging said withdrawn object, said alignment means predetermining the orientation of said object end relative to said chuck whereby said slot engagement means maintains said predetermined object end orientation for direct insertion of said object end in said chuck.

7. A hand held multi-object implement having a handle with a central longitudinal axis, an object selector cup rotatably mounted at an end of said handle to rotate about said central axis, a plurality of objects provided peripherally of said handle in a generally circular pattern about said handle axis, each object being provided in said handle to extend essentially parallel to said handle's axis, a chuck provided at said end of said handle, said chuck being aligned with said handle axis for receiving an object end and securing it against rotation, said cup having a continuous side wall with an interior surface spaced radially outwardly of the radial location of said circular pattern of objects and a closed cup end, an elongate slot extending from a central portion of said cup end and radially outwardly to the location of said objects in said handle, said cup being rotatable to position said slot in register with any desired object in said handle, said slot in said cup being of sufficient width and length to permit outward withdrawal of an object shaft from said handle in a direction generally parallel with said handle axis, said slot defining opposing cup slot wall portions along the length of the slot, characterized in that said object end has integrally formed therewith means for defining a shoulder which contacts said opposing cup slot wall portions, said shoulder means contacting said opposing cup slot wall portions for any rotational angular relationship of said object end with said slot, said shoulder means retaining said object end within said cup, said object end being movable along said slot towards said cup centre into alignment with said chuck for insertion of said object end into said chuck.

8. A multi-object implement according to claim 7, characterized in that said object is selected from the group of objects consisting of a tool bit, a pen, a cosmetic make-up stick, and kitchen utensil.

9. A multi-object implement according to claim 8, characterized in that said object is a tool bit and said implement is a hand tool.

10. A multibit hand tool according to claim 9, characterized in that said bit end has an enlarged head portion having a plurality of external operative faces, said enlarged head portion providing said shoulder means below said external operative faces, said chuck having a corresponding plurality of operative internal faces to receive and engage said enlarged head portion.

11. A multibit hand tool according to claim 9 or 10, characterized in that an exterior face of said bit selector cup end has a circular disc rotatably mounted thereon, said disc having a slot of a shape corresponding to said slot in said cup end, said disc being rotatable after said bit end is inserted in said chuck bore to encase thereby a shaft portion of said bit between a central slot portion of said disc and a central slot portion of said cup end to stabilize said bit during use.

12. A hand held multi-object implement having a handle with a central longitudinal axis, an object selector cup rotatably mounted at an end of said handle to rotate about said central axis, a plurality of elongate objects provided peripherally of said handle in a circular pattern about said handle axis, each object being provided in said handle to extend essentially parallel to said handle's axis, a chuck provided at said end of said handle, said chuck being aligned with said handle axis for receiving an object end and securing it against rotation, said cup having a continuous side wall with an interior surface spaced radially outwardly of the radial location of said circular pattern of objects and a closed cup end, an elongate slot extending from a central portion of said cup and radially outwardly to the location of said objects in said handle, said cup being rotatable to position said slot in register with any desired object in said handle, said slot in said cup being of sufficient width and length to permit outward withdrawal of an object shaft from said handle in a direction generally parallel with said handle axis, means for retaining a selected object end in said cup, said object end being movable along said slot towards said cup central portion into alignment with said chuck for insertion of said object end into said chuck, characterized in that said object end has outwardly projecting portions for cooperation with said chuck, said handle having a plurality of channels for receiving said objects, each said channel having recessed portions extending along its length to receive said object end outwardly projecting portions, a circular flange depending from said handle end and having a plurality of slots extending therethrough, each of said slots being radially aligned with a respective said recessed portion in one of said channels, said slot in said flange receiving one of said outwardly projecting portions upon withdrawal of said object end from a corresponding channel for insertion into said chuck.

13. A multi-object implement according to claim 12, characterized in that said object is selected from the group of objects consisting of a tool bit, a pen, a cosmetic make-up stick, and kitchen utensil.

14. A multi-object implement according to claim 13, characterized in that said object is a tool bit and said implement is a hand tool.

15. A multibit hand tool according to claim 14, characterized in that said bit end has an enlarged head portion presenting said outwardly projecting portions, said enlarged head portion being in the shape of a polygon, one of said recessed portions of one of said channels receiving a projecting portion of said polygon-shaped head portion and on withdrawal of said bit end from said channel, a corresponding said aligned slot in said flange receiving said projecting portion of said polygon-shaped head portion.

* * * * *